United States Patent [19]

Hiro et al.

[11] Patent Number: 4,860,898

[45] Date of Patent: Aug. 29, 1989

[54] PACKAGING ARRANGEMENT FOR ELECTROPHOTOGRAPHIC PHOTOSENSITIVE MEMBER

[75] Inventors: Masaaki Hiro; Masaru Nakagawa; Yoichi Kawamorita; Koji Yamazaki, all of Kanagawa, Japan

[73] Assignee: Canon Kabushiki Kaisha, Tokyo, Japan

[21] Appl. No.: 242,338

[22] Filed: Sep. 9, 1988

[30] Foreign Application Priority Data

Sep. 10, 1987 [JP] Japan ..... 62-227347

[51] Int. Cl.[4] ..... B65D 81/30

[52] U.S. Cl. ..... 206/455; 53/460; 206/389; 206/410; 355/133; 355/210; 355/211

[58] Field of Search ..... 53/396, 456, 460; 206/316, 389, 410, 454, 455, 456, 446; 355/3 BE, 3 DD, 3 DR, 3 R, 133

[56] References Cited

U.S. PATENT DOCUMENTS

| | | | |
|---|---|---|---|
| 4,655,578 | 4/1987 | Kurtz | 355/3 DD |
| 4,771,313 | 9/1988 | Kuroda et al. | 355/3 DD |
| 4,780,357 | 10/1988 | Akao | 206/455 |

FOREIGN PATENT DOCUMENTS

| | | | |
|---|---|---|---|
| 3124621 | 3/1982 | Fed. Rep. of Germany | 206/316 |
| 0035728 | 2/1985 | Japan | 206/316 |
| 0071645 | 4/1985 | Japan | 206/316 |
| 0114893 | 6/1985 | Japan | 355/3 DR |
| 0138281 | 6/1986 | Japan | 355/3 R |

*Primary Examiner*—Jimmy G. Foster

*Attorney, Agent, or Firm*—Fitzpatrick, Cella, Harper & Scinto

[57] ABSTRACT

A packaging arrangement and method for the user thereof to protect an electrophotographic photosensitive member which includes a packaging material for covering and protecting the electrophotographic photosensitive member from physical damage and is capable of generating a frictional electrostatic charge of the same polarity as the electrophotographic photosensitive material, whereby the packaging material has a stronger electron acceptor characteristic than the electrophotographic photosensitive material where the electrophotographic photosensitive material possesses a positive charge, and the packaging material has a stronger electron donor characteristic than the electrophotographic photosensitive material where the electrophotographic photosensitive material possesses a negative charge.

40 Claims, 2 Drawing Sheets

PACKAGING ARRANGEMENT FOR ELECTROPHOTOGRAPHIC PHOTOSENSITIVE MEMBER

BACKGROUND OF THE INVENTION

1. Field of the Invention

The present invention relates to an improved packaging arrangement for electrophotographic photosensitive member, and also to a packaging method for producing the improved packaging arrangement. The invention further relates to a packaging member for packaging an electrphotographic photosensitive member. More particularly, the invention is concerned with a packaging arrangement suitable for use in packaging an electrophotographic member so as to avoid any image defect, and also with a packaging method for producing such a packaging arrangement, as well as a packaging member for packaging an electrophotographic photosensitive member for such a packaging arrangement.

2. Related Background Art

Hitherto, inorganic photoconductive materials such as cadmium sulfide, selenium and zinc oxide have been used as electrophotographic photosensitive members. In recent years, however, organic photoconductive materials, as well as amorphous materials such as amorphous silicon, have been increasingly used as electrophotographic photosensitive materials. It has been recognized that, when such inorganic and organic photoconductive materials are used in so-called Carlson type electrophotography, any damage such as a dent or a scratch, as well as contamination by a finger print or other oily matter, seriously affects the quality of image formed on the photosensitive material. In order to eliminate such problems, various packaging device have been proposed. One such device is a case which is designed to keep the surface of the photosensitive member; such as selenium or amorphous silicon, away from any physical damage resulting from, for example, contact with an other member. Furthermore, replacement of such a photosensitive member required a great deal of very troublesome work which has to be carried out by a skilled professional.

Electrophotographic devices have become popular in recent years, which has given a rise to a demand for organic photoconductive photosensitive members packaged in such a manner as to enable ordinary users of electrophotographic devices to easily replace the photosensitive material. To cope with this demand, a method has been proposed in which a thin membrane or film is simply placed on the surface of a photosensitive member in such a manner as to enable the user to peel off the film after the photosensitive member has been installed in the electrophotographic device. This packaging method relying upon a thin film, however, has a critical problem in that the surface of the photosensitive member is electrostatically charged by charges which are generated due to friction between the film and the photosensitive member when the film is peeled off. Such electrostatic charges remaining on the surface of the photosensitive member cause so-called charge memory which appears as unevenness in the resulting image as well as other defect in the image formed on the photoconductive member after its exposure in an electrophotographic device.

SUMMARY OF THE INVENTION

Accordingly, an object of the present invention is to provide an improved packaging arrangement for packaging and protecting an electrophotographic photosensitive material, which avoids generation of charge memory when the packaging member is peeled off the electrophotographic member, thereby overcoming a problem of the prior art. More specifically, the packaging material is capable of generating frictional electrostatic charges of the same polarity as the electrophotographic photosensitive material.

Another object o the present invention is to provide an improved packaging arrangement for electrophotographic photosensitive member which enables the photosensitive member to be replaced easily in a photosensitive device while reducing the risk that the photosensitive member will be damaged.

Still another object of the present invention is to provide a packaging arrangement which is particularly suitable for use in combination with organic photoconductive photosensitive members and to minimize damage during replacement thereof.

A further object of the present invention is to provide a method for packaging and protecting an electrophotographic photosensitive member, which method is improved in such a way as to eliminate any charge memory when a packaging member is peeled off the electrophotographic member, thereby overcoming a problem of the prior art.

A still further object of the present invention is to provide a method for packaging electrophotographic photosensitive member which enables the photosensitive member to be replaced easily on a photosensitive device without any risk for the photosensitive member to be damaged.

A still further object of the present invention is to provide a packaging method which is particularly suitable for use with organic photoconductive photosensitive member.

A still further object of the present invention is to provide a packaging member for packaging an electrophotographic photosensitive member in such a way as to avoid generation of charge memory when a packaging member is peeled off the electrophotographic member, thereby overcoming a problem of the prior art.

A still further object of the present invention is to provide a packaging member for packaging an electrophotographic photosensitive member which enables the photosensitive member to be replaced easily on a photosensitive device with minimal risk of the photosensitive member be coming damaged.

A still further object of the present invention is to provide a packaging member for packaging an organic photoconductive photosensitive member packaged in such a manner as to avoid damage during replacement.

The inventors have discovered that generation of charge memory can be avoided by the use of a packaging film which generates frictional electrostatic charges of the same polarity as the polarity of charging of the photosensitive member. The present invention is based upon this discovery.

According to one aspect of the present invention, there is provided a packaging arrangement for packaging an electrophotographic photosensitive member, comprising: an electrophotographic photosensitive member; and a packaging member covering and protecting said electrophotographic photosensitive member from physical damage and capable of generating frictional electrostatic charges on the surface of said electrophotographic photosensitive member in the same polarity as the electrophotographic photosensitive member. Specifically, the frictional electrostatic charges are of the same polarity as the polarity of charging of the photosensitive material.

According to another aspect of the present invention, there is provided a packaging method for packaging an electrophotographic photosensitive member, comprising: providing a sheet having edges of a packaging member for covering and protecting said electrophotographic photosensitive member from physical damage and capable of generating a frictional electrostatic charge on the surface of the electrophotographic photosensitive member in the same polarity as the electrophotographic photosensitive member, whereby the packaging member has a stronger electron acceptor characteristic than said electrophotographic photosensitive member when said electrophotographic photosensitive member possesses a positive charge, and said packaging member has a stronger electron donor characteristic than said electrophotographic photosensitive member when said electrophotographic photosensitive member possesses a negative charge; and applying the sheet to cover the surface area of the electrophotographic photosensitive member.

According to still another aspect of the present invention, there is provided a packaging member for packaging an electrophotographic photosensitive mmember, comprising being formed from a material which is capable of generating frictional electrostatic charge on the surface of said electrophotographic photosensitive member in the same polarity as the charging polarity of said electrophotographic photosensitive member.

DESCRIPTION OF THE PREFERRED EMBODIMENTS

Figure 1:
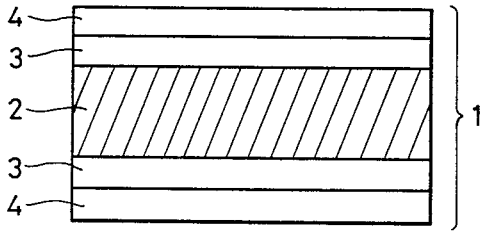
FIG. 1 is a sectional view of a protective packaging member of the present invention for protecting an electrophotographic photosensitive member and showing, in particular, a laminated structure of the protective packaging member.

Although not completely understood, it is believed that the phenomenon of charge memory is attributable to the following reason. There are two types of polarity of charging of an electrophotographic photosensitive member: namely, positive polarity charging and negative polarity charging. In carrying out a charging operation, a certain potential is imparted to the photosensitive member by a corona discharge. The most popular photosensitive member has a laminated structure constituted by a charge generating layer formed on a conductive substrate and generating positive and negative charges when irradiated with light, and a charge transportation layer formed on the charge generating layer and capable of transporting positive charges generated by the charge generating layer. Thus, in this type of photosensitive member, the charge transportation layer constitutes the uppermost layer so that the member exhibits a negative charging characteristic. A negative charging potential imparted to the photosensitive member is gradually attenuated because the negative charges are cancelled as a result of movement of carriers (holes) generated in the charge generating layer or of an injection of carriers from the conductive substrate.

Conversely, when a positive charging potential is imparted to the photosensitive member having a negative charging characteristic, the positive charges remain on the surface of the member because electrons which would cancel the positive charges are prevented from moving across the charge transportation layer. When imaging is carried out by imparting a negative charging potential to the photosensitive member holding positive residual charges formed as a result of, for example, friction charging, the surface potential is locally reduced in the area where the positive residual charges exist, with the result that defects such as white blanking or unevenness are caused in the product image due to charge memory. Similarly, in the case of a positive charging type organic photoconductive photosensitive member, which has a charge generating layer as the uppermost layer, charge memory is caused when charges of a polarity opposite to the characteristic charging polarity of member, i.e., negative charges, are imparted to the member surface.

Thus, the present invention making use of a discovery that charge memory can be avoided if the packaging member for the photosensitive member is made of a material which is capable of generating friction charges of the same polarity as the polarity of the charging characteristic of the photosensitive member.

As will be understood from the foregoing description, the nature of the packaging member according to the invention is closely related to the surface characteristic of the photosensitive member to be packaged.

In general, an organic photoconductive photosensitive member contains a binder resin because the charge transportation material and the charge generating material, which are usually low-molecular compounds, exhibit poor film formability. Therefore, the polarity of the frictional charging characteristic of the photosensitive member is determined by the relation between the resin used as the binder and the packaging material.

Table 1 shows the order of frictional charging tendency. When the packaging member used has a stronger electron donor characteristic than the binding resin in the surface of the photosensitvie member, negative charges are imparted to the surface of the photosensitive member. Conversely, when the packaging member used exhibits a stronger electron acceptor characteristic than the binder resin, positive charges are imparted to the surface of the photosensitive member.

For instance, in the case of a photosensitive member having a surface layer containing polycarbonate as a binding resin and exhibiting a negative charging characteristic, the packaging material suitably used is a resin which contains, as its major component, a material which exhibits stronger electron donor characteristic, such as nylon, polymethylmethacrylte, polyvinylacetate, polyethyleneterephthalate, pilyvinylchloride and so forth.

TABLE 1

| ORDER OF FRICTIONAL CHARGING TENDENCY | |
|---|---|
| electron donor (+) | nylon |
| | cellulose |
| | cellulose acetate |

TABLE 1-continued

| ORDER OF FRICTIONAL CHARGING TENDENCY | |
|---|---|
| | polymethylmethacrylate (PMMA) |
| | polyvinylacetate |
| | polyethyleneterephthalate (PFT) |
| | polyacrylonitrile (PAN) |
| | polyvinylchloride (PVC) |
| | polycarbonate (PC) |
| | polychloroether |
| | polyvinylidenechloride |
| | poly-2,6-dimethylphenyleneoxide |
| electron acceptor (−) | polystyrene (PS) |
| | polyethylene (PE) |
| | polypropylene (PP) |
| | polytetrafluoroethylene (PTPE) |

The packaging member of the invention can have various forms. For instance, the packaging member may be formed as a sheet or a film which is adapted to be wound around the photosensitive material. The packaging member may also be in the form of a sack made of a thin film and designed to receive the photosensitive member. The packaging member may also be in the form of a cylindrical tube having a diameter substantially the same as the diameter of a cylindrical electrophotographic photosensitive member. In another example, the packaging member may be in the form of a pair of rigid plates between which a sheet-like photosensitive member is sandwiched so as not to be bent.

When the packaging member is formed as a sheet, it also can have various configurations such as a single layer sheet, a laminated structure composed of a plurality of sheets, a laminated structure composed of a sheet of the packaging member together with a metallic sheet, and an evaporation deposition type sheet in which a metal is deposited by evaporation on the surface of a sheet of the packaging member. The packaging member of the invention may be provided with a light-shielding function. To this end, the material of the packaging member of the invention may contain carbon or a coloring agent or the surface of the packaging member may be suitably colored. Such light-shielding function is particularly preferred in the case of organic photoconductive photosensitive material from the standpoint of shielding of light.

The packaging member of the present invention can be applied to various forms of photosensitive members such as cylinders, sheets and so forth. The photosensitive member to be packaged by the packaging member of the invention may have a laminated structure or may have only one layer.

The invention will be fully understood from the following description of specific Examples.

EXAMPLE 1 (TEST NOS. 1-5)

An aluminum cylinder having a diameter of 80 mm and a length of 300 mm was used as a conductive substrate. The cylinder was dipped in a 5% methanol solution of soluble nylon (6-66-610-12 quarternary nylon copolymer) so that an under-coating layer of 1 μm was formed.

Then, 10 weight parts of a bis-azo pigment having the following structural formula:

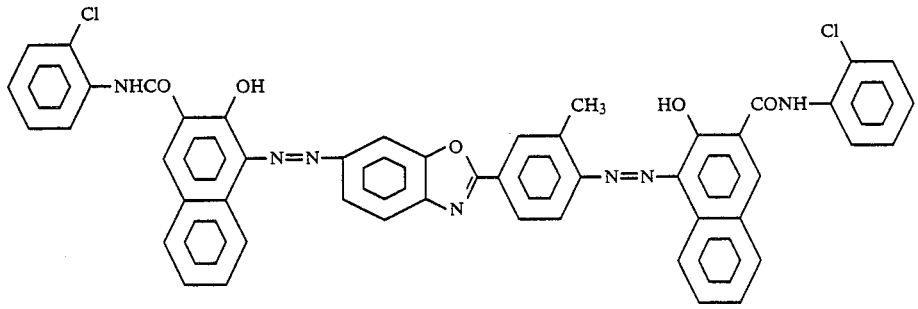

was dispersed for 20 hours together with 5 weight parts of polyvinylbutylate (butyral degree 68%, number mean molecular weight 20000) and 50 weight parts of cyclohexane, by means of a sand mill using glass beads of 1 mm dia. Methylethylketone, in an amount varied suitably between 70 and 120 weight parts, was added to the dispersion liquid and the liquid thus formed was applied to the under-coating layer so as to form a charge generating layer of 0.1 μm thick.

Subsequently, 10 weight parts of bisphenol Z type polycarbonate (viscosity mean molecular weight 30000) and 10 weight parts of a hydrazone compound having the following structural formula:

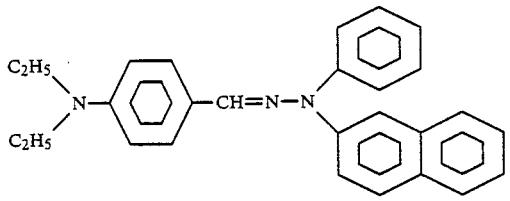

were dissolved in 65 weight parts of monochlorobenzene.

The thus formed solution was applied by dipping the surface of the charge generating layer so as to form a charge transportation layer having a thickness of 18 μm. The thus formed sample of the photosensitive member is referred to as "photosensitive member sample 1".

Another photosensitive material was formed by the same process as the sample 1 except that bisphenol A type polycarbonate (viscosity mean molecular weight 28000) was used in place of bisphenol Z type polycarbonate. This photosensitive material is referred to as "photosensitive member sample 2".

Still another type of photosensitive member was formed by the same process as the sample 1 except that an aluminum sheet of 50 μm thick as the conductive substrate was used in place of aluminum cylinder. A sheet-like photosensitive member thus formed is referred to as "photosensitive member sample 3".

Photosensitive member samples 1, 2 and 3 exhibit negative charging polarity.

Packaging members of various materials having a stronger electron donor characteristic than polycarbonate were wound on these photosensitive members. In case of a sheet-like photosensitive member 3, a pair of packaging members were used to sandwich the photosensitive member.

After separating the packaging member from each photosensitive member, the photosensitive member was subjected to an evaluation of imaging performance conducted on a copying machine adapted for executing an electrophotographic process including corona charging at −5.5 kv, image exposure, development by dry toner, transfer to ordinary paper and cleaning. The results of the evaluation are shown in Table 2.

COMPARISON EXAMPLE 1 (TEST NOS. 6, 7)

Packaging members made of a material having a stronger electron acceptor characteristic than polycarbonate were wound arouind the photosensitive member samples 1 and 3 of Example 1. After separating the packaging members, the photosensitive member samples 1 and 3 were subjected to the same imaging evaluatiuon test conducted under the same conditions as Example 1.

The evaluation was conducted by carefully examining the quality of the copied images through a visual check for any image defect such as white blanking and unevenness of image density.

TABLE 2

| Test No. | Sample No. | Charging polarity of photosensitive member | Packaging material | Result of imaging evaluation |
|---|---|---|---|---|
| 1 | 1 | – | nylon sheet | good |
| 2 | 3 | – | polymethyl-methacrylate plate | good |
| 3 | 3 | – | polyvinylacetate plate | good |
| 4 | 2 | – | polyethylene terephthalate sheet | good |
| 5 | 2 | – | polyvinylchloride sheet | good |
| 6 | 3 | – | polysthrene plate | white blank |
| 7 | 1 | – | polyethylene sheet | white blank |

EXAMPLE 2 (TEST NOS. 8–10)

10 weight parts of the hydrazone compound used in Example 1 and 10 weight parts of bisphenol Z type polycarbonate were dissolved in 65 parts of monochlorobenzene. The solution was applied was applied to an aluminum sheet which was coated with an under an under-coating layer in the same manner as Example 1, so that a charge transportation layer of 12 μm was formed.

Subsequently, 10 weight parts of the bis-azo pigment used in Example 1 was added to 100 weight parts of 10 wt % cyclohexane solution of bisphenol Z type polycarbonate (viscosity mean molecular weight 53000), and the mixture was dispersed for 20 hours by a sand mill using glass beads of 1 mm dia. The thus formed solution was applied to the above-mentioned charge transportation layer, so that a charge generating layer of 2 μm thick was formed. This photosensitive layer will be referred to as "photosensitive member sample 4".

The charge transportation layer and the charge generating layer of the photosensitive member sample 4 were formed on an aluminum cylinder used in Example 1 having an under-coating layer, whereby a photosensitive material referred to as "photosensitive member sample 5" was prepared. A photosensitive member, referred to as "photosensitive member sample 6" was formed by applying, to the same aluminum cylinder as that used in Example 1, an under-coating layer, the charge transportation transporting solution and a charge generating layer solution, which were prepared in the same manner as those used in the "photosnesitive member sample 5" except that bisphenol A type polycarbonate (viscosity mean molecular weight 40000) was used in place of bisphenol Z type polycarbonate in the charge transfer layer and dichloromethane was used in place of cyclohexane in the charge generating layer.

Photosensitive members samples 4, 5 and 6 show positive charging polarity.

Packaging members of various materials having a stronger electron acceptor characteristic than polycarbonate were wound around these samples of photosensitive member. After separation of the packaging member, the photosensitive members were subjected to an imaging evaluation test carried out on a copying machine which is adapted to perform an electrophotographic process including corona charging at +5.5 kv, image exposure, dry toner development, transfer to ordinary paper and cleaning. The results are shown in Table 3.

COMPARISON EXAMPLE 2 (TEST NOS. 11 and 12)

Packaging members of materials having a stronger electron donor characteristic than polycarbonate were wound around hotosensitive member samples 5 and 6 prepared in Example 2. After separation of the packaging members, the photosensitive members were subjected to an imaging evaluation test conducted under the same conditions as Example 2, the results of which also are shown in Table 3.

TABLE 3

| Test No. | Sample No. | Charging polarity of photosensitive member | Packaging material | Result of imaging evaluation |
|---|---|---|---|---|
| 8 | 4 | + | polystyrene plate | good |
| 9 | 5 | + | polyethylene sheet | good |
| 10 | 6 | + | polypropylene sheet | good |
| 11 | 5 | + | nylon sheet | white blank |
| 12 | 6 | + | polyethylene terephthalate | white blank |

EXAMPLE 3 (TEST NOS. 13–16)

Photosensitive drums as photosensitive member samples 7, 8 and 9 were prepared through the same process as Example 1 except that polymethylmethacrylate (number mean molecular weight 45000), methylmethacrylate/styrene copolymer (weight ratio 8/2, number molecular weight 62000) and methylmethacrylate/ethylmethacrylate copolymer (weight ratio 6/4, number mean molecular weight 55000) were used, respectively, in place of polycarbonate in Example 1.

Packaging members of various materials having a stronger electron donator characteristic than polymethylmethacrylate were wound arouns these photosensitive members.

After separating the packaging member from each photosensitive member, the photosensitive material was subjected to an evaluation of imaging performance conducted on a copying machine adapted for executing an electrophotographic process including corona charging at −5.5 kv, image exposure, development by dry toner, transfer to ordinary paper and cleaning. The results of the evaluation are shown in Table 4.

COMPARISON EXAMPLE 3 (TEST NOS. 17 and 18)

Packaging members made of a material having a stronger electron acceptor characteristic than polyethylenemethacrylate were wound around each of the photosensitive member samples 7 and 8 of Example 3. After separating the packaging members, the samples 7 and 8 were subjected to the same imaging evaluatiuon test conducted under the same conditions as Example 3, the results of which also are shown in Table 4.

TABLE 4

| Test No. | Sample No. | Charging polarity of photosensitive member | Packaging material | Result of image evaluation |
|---|---|---|---|---|
| 13 | 7 | − | nylon sheet | good |
| 14 | 7 | − | cellulose sheet | good |
| 15 | 8 | − | nylon sheet | good |
| 16 | 9 | − | cellulose sheet | good |
| 17 | 7 | − | polyethylene terephthalate sheet | white blank |
| 18 | 8 | − | polyethylene sheet | white blank |

EXAMPLE 4 (TEST NOS. 19–25)

Photosensitive members were formed by the same process as Example 2, except that polymethylmethacrylate, methylmethacrylate/styrene copolymer and methylmethacrylate copolymer used in Example 3 were used in place of polycarbonate in Example 2.

The drum-type photosensitive member formed by using polymethylmethacrylate and methylmethacrylate/ styrene copolymer are referred to as photosensitive member samples 10 and 11, respectively, while the sheet-type photosensitive members formed by using polymethylmethacrylate and methylmethacrylate/ethylenemethacrylate copolymer are referred to as photosensitive member samples 12 and 13, respectively.

Packaging members of various materials having a stronger electron acceptor characteristic than polymethylmethacrylate were wound around these samples of photosensitive member. After removal of the packaging member, the photosensitive members were subjected to an imaging evaluation test carried out on a copying machine which is adapted to perform an electrophotographic process including corona charging at +5.5 kv, image exposure, dry toner development, transfer to ordinary paper and cleaning. The results are shown in Table 5.

COMPARISON EXAMPLE 4 (TEST NOS. 26 AND 27)

Packaging members of materials having stronger electron donor characteristic than polymethylmethacrylate were wound around each of the photosensitive member samples 10 and 11 of Example 4. After separation of the packaging members, the photosensitive members were subjected to an imaging evaluation test conducted under the same conditions as Example 4, the results of which also are shown in Table 5.

TABLE 5

| Test No. | Sample No. | Charging polarity of photosensitive members | Packaging material | Result of imaging evaluation |
|---|---|---|---|---|
| 19 | 12 | + | polyvinyl acetate plate | good |
| 20 | 10 | + | polyvinyl chloride sheet | good |
| 21 | 11 | + | polyethylene terephthalate sheet | good |
| 22 | 13 | + | polycarbonate | good |
| 23 | 12 | + | polystyrene plate | good |
| 24 | 10 | + | polyethylene sheet | good |
| 25 | 11 | + | polypropylene sheet | good |
| 26 | 10 | + | nylon sheet | white blank |
| 27 | 11 | + | cellulose sheet | white blank |

EXAMPLE 5 (TEST NOS. 28–33)

Photosensitive drums and sheets were prepared by the same process as Example 1, except that polystyrene (number mean molecular weight 65000), in photosensitive member samples 14 and 16 and styrene/methylmethacrylate copolymer (weight ratio 8/2, number mean molecular weight 84000), in photosensitive member samples 15 and 17, were used in place of the polycarbonate used in Example 1.

Photosensitive drums employing aluminum cylinders as the conductive substrate are used for photosensitive member samples 14 and 15, while photosensitive members using aluminum sheets are used for photosensitive member samples 16 and 17.

Packaging members of various materials having a stronger electron donor characteristic than polystyrene were wound around these photosensitive members. In case of a sheet-like photosensitive material, a pair of packaging sheets were used to sandwich the photosensitive member.

After separating the packaging member from each photosensitive member, the photosensitive member was subjected to an evaluation of imaging performance conducted on a copying machine adapted for executing an electrophotographic process including corona charging at −5.5 kv, image exposure, development by dry toner, transfer to ordinary paper and cleaning. The results of the evaluation are shown in Table 6.

COMPARISON EXAMPLE 5 (TEST NOS. 34 AND 35)

Packaging members made of a material having a stronger electron acceptor characteristic than polystyrene were wound around each of the photosensitive member samples 14 and 15 of Example 5. After separating the packaging members, the photosensitive member samples 14 and 15 were subjected to the same imaging evaluation test conducted under the same conditions as Example 5, the results of which also are shown in Table 6.

TABLE 6

| Test No. | Sample No. | Charging polarity of photosensitive member | Packaging material | Result of imaging evaluation |
|---|---|---|---|---|
| 28 | 14 | – | nylon sheet | good |
| 29 | 16 | – | polymethylmethacrylate sheet | good |
| 30 | 17 | – | polyvinyl acetate sheet | good |
| 31 | 14 | – | polyethylene terephthalate sheet | good |
| 32 | 15 | – | polyvinylchloride sheet | good |
| 33 | 16 | – | polycarbonate plate | good |
| 34 | 14 | – | polyehylene sheet | white blank |
| 35 | 15 | – | polypropylene sheet | white blank |

EXAMPLE 6 (TEST NOS. 36 AND 37)

Photosensitive drums were prepared as photosensitive member samples 19 and 20 by the same process as Example 2, except that polystyrene and styrene/methylmethacrylate copolymer were used, respectively, in place of the polycarbonate used in Example 2, photosensitive member samples 19 and 20 also used aluminum cylinders as the substrates.

Packaging members of various materials having a stronger electron acceptor characteristic than polystyrene were wound around these photosensitive members.

After separating the packaging member from each photosensitive member, the photosensitive member was subjected to an evaluation of imaging performance conducted on a copying machine adapted for executing an electrophotographic process including corona charging at +5.5 kv, image exposure, development by dry toner, transfer to an ordinary paper and cleaning. The results of the evaluation are shown in Table 7.

COMPARISON EXAMPLE 6 (TEST NOS. 36 AND 37)

Packaging members made of a material having a stronger electron donor characteristic than polystyrene were wound around each of the photosensitive member samples 19 and 20 of Example 6. After separating the packaging members, the samples 19 and 20 were subjected to the same imaging evaluation test conducted under the same conditions as Example 6, the results of which also are shown in Table 7.

TABLE 7

| Test No. | Sample No. | Charging polarity of photosentive member | Packaging material | Result of imaging evaluation |
|---|---|---|---|---|
| 36 | 19 | + | polyethylene sheet | good |
| 37 | 20 | + | polypropylene sheet | good |
| 38 | 19 | + | nylon sheet | white blank |
| 39 | 20 | + | polyethylene terephthalate sheet | white blank |

Figure 2:
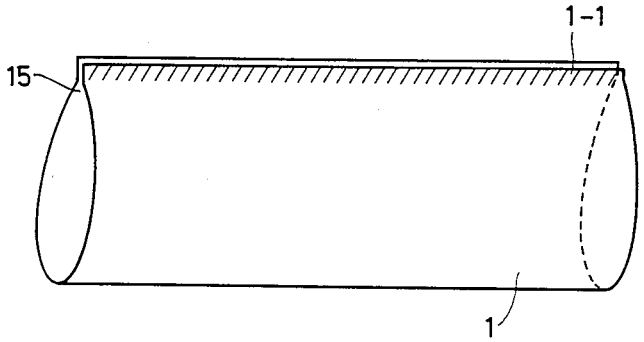
FIG. 2 is a perspective view of the protective packaging member shown in FIG. 1.
Figure 3:
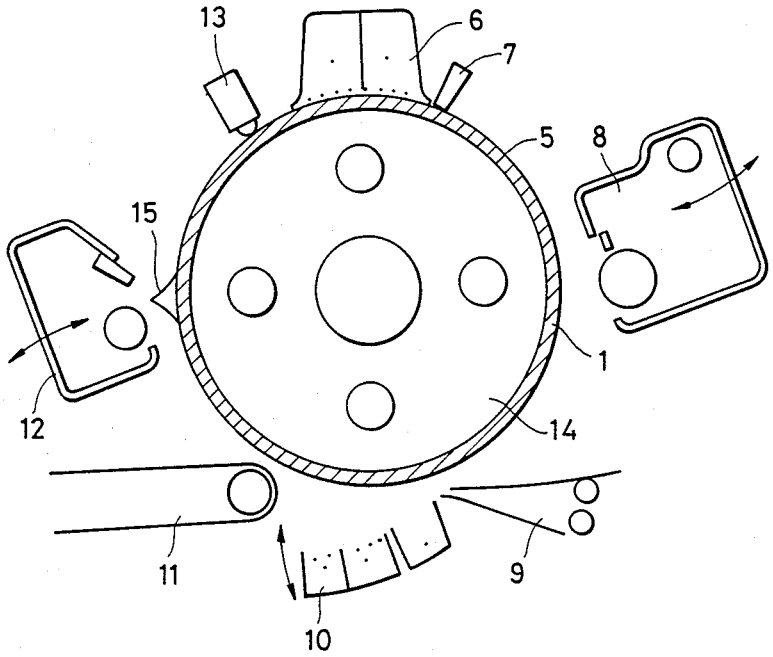
FIG. 3 is a schematic sectional view of a photosensitive member covered with the protective packaging member of FIG. 1 and mounted on an electrophotographic device.

Although the packaging members used in Examples described hereinabove are designed to wrap around the electrophotographic photosensitive member and be in direct contact therewith, another embodiment includes the packaging member of the present invention having the form of a cylindrical protecting member of a diameter substantially the same as the electrophotographic photosensitive member. An example of such a protecting member is shown in FIGS. 1 and 2, and an electrophotographic photosensitive member protected by such a protecting member positioned in an electrophotographic device is shown in FIG. 3.

As shown in FIG. 1, the protecting member has laminate layers 3 and 4 formed on each side of a carrier 2. The laminated rectangular sheet material thus formed is shaped into a cylindrical form with a diameter substantially the same as the electrophotographic photosensitive member, as shown in FIG. 2. The opposing ends of the laminated sheet are bonded together to form a ridge 15. The electrophotographic photosensitive member thus wrapped in the protective member 1 is mounted in an electrophotographic device in a manner shown in FIG. 3. In FIG. 3, the photosensitive member is denoted by numeral 5. The electrophotographic device has a primary charger 6, a blank exposure unit 7, a developing unit 8, a paper feed guide 9, a transfer/separation charger 10, a conveyor system 11, a cleaner unit 12, a pre-exposure unit 13 and a flange 14. The protecting member of Example 7 present invention will be described with reference to FIGS. 1 to 3.

EXAMPLE 7

The photosensitive member 5 of Example 7 is identical to photosensitive member sample 1 used in Example 1. The protective member shown in FIG. 1 was prepared as follows. The carrier 2 was formed from a polyethylene sheet of 40 μm thickness by preparing polyethylene through mixing 85 wt % of low-density polyethylene (SUNTEC LD, produced by Asahi Kasei Kogyo) and 15 wt % of high-density polyethylene (SUNTEC HD, produced by Asahi Kasei Kogyo), and dispersing 15 wt % of carbon in the polyethylene. A polyethylene sheet 3 of 15 μm with no dipersion of carbon and a nylon 66 sheet 4 of 15 μm thickness were formed on each side of the carrier 2, whereby a laminated sheet member was formed. The thus formed sheet was then shaped substantially in the same diameter as the photosensitive member which has a diameter of 80 mm and a length of 300 mm, as shown in FIG. 2. The parallel opposing edges of the rectangular laminated sheet are joined and bonded after wrapping the photosensitive member, so as to form a ridge or a lug as shown in FIG. 2. The bonding may be effected by heat-seal bonding or by bonding using an adhesive. The width of the bonding area is preferably 0.5 to 3 mm.

FIG. 3 is a schematic sectional view showing the photosensitive member 5 wrapped by the protecting member 1 mounted in a copying machine.

The photosensitive member thus mounted can easily be dismounted even by those who are not professionally trained, as will be explained below with reference to FIG. 3.

Namely, for the purpose of dismounting the photosensitive member, the user disengages chargers 6 and 10 and then removes the cleaner unit 12 and the developing unit 8. He then detaches the flange 14. Particles of residual toner or toner particles freed during removal of the cleaner unit 12 and the developing unit 8 remain on the portions of the photosensitive member 5 facing these units. By positioning the bonded portion of the protective member at the area contacted by the cleaner unit which holds the heaviest stacking of toner particles, it is possible to mount and dismount the photosensitive member in such a manner as to minimize the amount of the toner particles and other material which are dropped from the photosensitive material. The clearance between the surface of the photosensitive member and the underside of the crest 15 of the bonded region is preferably 2 to 6 mm. When the protective member 1 is formed by heat-seal bonding, nylon 66 alone cannot provide sufficient bonding strength. In addition, it is necessary to disperse in the polyethylene of the carrier the carbon particles which would shield the organic photoconductive photosensitive member from strong exposure to light and ultraviolet rays because it is difficult to disperse the carbon particles in nylon 66. For these reasons, the protecting member of Example 7 of present invention has a laminated structure. Preferably, the thickness of the sheet used as material for the protecting member ranges between 100 and 400 μm.

The photosensitive member wrapped by the protecting member was subjected to a scratching test which was conducted by using a Haidon surface tester operated to axially scratch the photosensitive member with a diamond stylus under the load of 5, 10 and 20 g (grams). Although exfoliation of photosensitive layer was observed under the load levels of 10 g and 20 g in the region where the layer was not protected by the protecting member, no exfoliation was caused in the region covered by the protecting member.

In order to confirm the effectiveness of the protecting member against any damaging force which would be generated by mechanical interference with the machine parts in the actual machines, a test was conducted by using a photosensitive member wrapped by a protecting member of a diameter substantially the same as the diameter of the photosensitive member, on a copying machine Model NP 5540 made by CANON INC., and CLC1 (Color Laser Copier 1) of the same manufacturer. The test was conducted by withdrawing the photosensitive member while upwardly urging the same into contact with the exposure unit and the potential sensor. Although the withdrawal was conducted twice in each case, no abnormality was found in the appearance of the photosensitive member nor in the image formed on the photosensitive member.

The photosensitive member was electrostatically charged due to friction with the protecting member during the withdrawal. The potential after the electrostatic charging was −800 to −2000 V, i.e., the polarity of the friction charging was the same as the polarity of the charging characteristic of the photosensitive member, and no abnormality in the image was observed. This means that no charge memory had been caused on the photosensitive member.

COMPARISON EXAMPLE 7

An evaluation test was executed under the same conditions as Example 7, except that a polyethylene sheet 2 of 100 μm thickness formed into a cylindrical shape by heat-seal bonding was used in place of the protecting member of Example 7.

The photosensitive member wrapped by the polyethylene sheet, when subjected to an imaging operation after being left for 10 minutes in the wrap of the polyethylene sheet, exhibited an unevenness of image density in the portion of the photosensitive material other than the area under the crest 15 of the bonded region, i.e., over the entire area contacted by the polyethylene sheet, although no substantial difference was observed in anti-scratching effect and photo-memory prevention effect. This is attributable to the generation of charge memory caused as a result of frictional electrostatic charging to a potential of +800 to +2000 V due to friction between the photosensitive material and the polyethylene sheet.

From this fact, it is understood that the protecting member of Example 7 provides superior effect in preenting any unfavorable effect which may be caused by charge memory.

What is claimed is:

1. A packaging arrangement for an electrophotographic photosensitive member, comprising:

an electrophotographic photosensitive member; and a packaging member covering and protecting said electrophotographic photosensitive member from physical damage and capable of generating a frictional electrostatic charge on the surface of said electrophotographic photosensitive member in the same polarity as the electrophotographic photosensitive member.

2. The packaging arrangement according to claim 1, wherein said packaging material has a stronger electron acceptor characteristic than said electrophotographic photosensitive member when said electrophotographic photosensitive member possesses a positive charge, and said packaging member has a stronger electron donor characteristic than said electrophotographic photosensitive member when said electrophotographic photosensitive member has a negative charge.

3. The packaging arrangement according to claim 1, wherein said packaging member further includes a light-shielding element.

4. The packaging arrangement according to claim 1, wherein said packaging member includes at least two laminated layers.

5. The packaging arrangement according to claim 1, wherein said packaging member is secured to each side of a base made of polyethylene, thereby providing a laminated structure.

6. The packaging arrangement according to claim 1, wherein said packaging member includes a metal sheet.

7. The packaging arrangement according to claim 1, wherein said electrophotographic photosensitive member is an organic photoconductive material.

8. The packaging arrangement according to claim 1, wherein said electrophotographic photosensitive member has a surface layer which contains at least a polycarbonate resin.

9. The packaging arrangement according to claim 8, wherein said electrophotographic photosensitive member has negative charging characteristic, and wherein the main component of said material of said packaging member is selected from a group consisting of nylon, polymethylmethacrylate, polyvinylacetate, polyethylene terephthalate and polyvinylchloride.

10. The packaging arrangement according to claim 8, wherein said electrophotographic photosensitive member has positive charging characteristic, and wherein the main component of said material of said packaging member is selected from a group consisting of polystyrene, polyethylene and polypropylene.

11. The packaging arrangement according to claim 1, wherein said electrophotographic photosensitive member has a surface layer which contains at least a polymethylmethacrylate resin.

12. The packaging arrangement according to claim 11, wherein said electrophotographic photosensitive member has negative charging characteristic, and wherein the main component of said material of said packaging member is selected from a group consisting of nylon and cellulose.

13. The packaging arrangement according to claim 11, wherein said electrophotographic photosensitive member has positive charging characteristic, and wherein the main component of said material of said packaging member is selected from a group consisting of polyvinylacetate, polyvinylchloride, polyethylene terephthalate, polycarbonate, polystyrene, polyethylene and polypropylene.

14. The packaging arrangement according to claim 1, wherein said electrophotographic photosensitive member has a surface layer which contains at least a polystyrene resin.

15. The packaging arrangement according to claim 14, wherein said electrophotographic photosensitive member has negative charging characteristic, and wherein the main component of said material of said packaging member is selected from a group consisting of nylon, polymethylmethacrylate, polyvinylacetate, polyethyleneterephthalate, polyvinylchloride and polycarbonate.

16. The packaging arrangement according to claim 14, wherein said electrophotographic photosensitive member has positive charging characteristic, and wherein the main component of said material of said packaging member is selected from a group consisting of polyethylene and polypropylene.

17. The packaging arrangement according to claim 1, wherein said packaging member is in the form of a cylindrical tube having a diameter substantially the same as the diameter of a cylindrical electrophotographic photosensitive member.

18. The packaging arrangement according to claim 1, wherein said packaging member is wrapped around said electrophotographic photosensitive member.

19. The packaging arrangement according to claim 1, wherein said packaging member is formed as a cylindrical protecting member having a diameter substantially the same as the diameter of said electriphotographic photosensitive member.

20. The packaging arrangement according to claim 19, wherein said cylindrical protecting member is formed by jointing and bonding parallel opposite edges of a sheet of said packaging member near said opposite edges at the surface facing the interior of the cylinder.

21. A method of packaging an electrophotographic photosensitive member, comprising:

providing a sheet having edges of a packaging member for covering and protecting said electrophotographic photosensitive member from physical damage and capable of generating a frictional electrostatic charge on the surface of said electrophotographic photosensitive member in the same polarity as the electrophotographic photosensitive member, whereby said packaging member has a stronger electron acceptor characteristic than said electrophotographic photosensitive member when said electrophotographic photosensitive member possesses a positive charge, and said packaging member has a stronger electron donor characteristic than said electrophotographic photosensitive member when said electrophotographic photosensitive member possesses a negative charge; and applying said sheet to cover the surface area of said electrophotographic photosensitive member.

22. A method according to claim 21, wherein said step of applying said sheet comprises wrapping said sheet around the electrophotographic photosensitive member.

23. A method for packaging a cylindrical electrophotographic photosensitive member, comprising:

providing a packaging member for covering and protecting said electrophotographic photosensitive member from physical damage and capable of generating a frictional electrostatic charge on the surface of said electrophotographic photosensitive member in the same polarity as the electrophotographic photosensitive member, whereby said packaging member has a stronger electron acceptor characteristic than said electrophotographic photosensitive member when said electrophotographic photosensitive member possesses a positive charge, and said packaging member has a stronger electron donor characteristic than said electrophotographic photosensitive member possesses a negative charge;

shaping said packaging member into a cylindrical tube having a diameter substantially the same as the diameter of said cylindrical electrophotographic photosensitive member; and inserting said cylindrical electrophotographic photosensitive member into said cylindrical tube.

24. A method according to claim 23, wherein said step of shaping said packaging member comprises jointing and bonding parallel opposite ends of a sheet of said packaging member near said opposite edges at the surface facing the interior of the cylinder.

25. A packaging member for packaging an electrophotographic photosensitive member, comprising a material which is capable of generating frictional electrostatic charges on the surface of said electrophotographic photosensitive member in the same polarity as the charging polarity of said electrophotographic photoensitive member.

26. A packaging member for packaging an electrophotographic photosnesitive member according to claim 25, wherein said electrophotographic photosensitive member has a surface layer which contains at least a polycarbonate resin.

27. A packaging member for packaging an electrophotographic photosensitive member according to claim 26, wherein said electrophotographic photosensitive member has negative charging characteristic, and wherein the main component of said material of said packaging member is selected from a group consisting of nylon, polymethylmethacrylate, polyvinylacetate, polyethylene terephthalate and polyvinylchloride.

28. A packaging member for packaging an electrophotographic photosensitive member according to claim 26, wherein said electrophotographic photosensitive member has positive charging characteristic, and wherein the main component of said material of said packaging member is selected from a group consisting of polystyrene, polyethylene and polypropylene. polyethylene terephthalate and polyvinylchloride.

29. A packaging member for packaging an electrophotographic photosensitive member according to claim 25, wherein said electrophotographic photosensitive member has a surface layer which contains at least a polymethylmethacrylate resin.

30. A packaging member for packaging an electrophotographic photosensitive member according to claim 29, wherein said electrophotographic photosensitive member has negative charging characteristic, and wherein the main component of said material of said packaging member is selected from a group consisting of nylon and cellulose.

31. A packaging member for packaging an electrophotographic photosensitive member according to claim 29, wherein said electrophotographic photosensitive member has positive charging characteristic, and wherein the main component of said material of said packaging member is selected from a group consisting of polyvinylacetate, polyvinylchloride, polyethylene terephthalate, polycarbonate, polystyrene, polyethylene and polypropylene.

32. A packaging member for packaging an electrophotographic photosensitive member according to claim 25, wherein said electrophotographic photosensitive member has a surface layer which contains at least a polystyrene resin.

33. A packaging member for packaging an electrophotographic photosensitive member according to claim 32, wherein said electrophotographic photosensitive member has negative charging characteristic, and wherein the main component of said material of said packaging member is selected from a group consisting of nylon, polymethylmethacrylate, polyvinylacetate, polyethyleneterephthalate, polyvinylchloride and polycarbonate.

34. A packaging member for packaging an electrophotographic photosensitive member according to claim 32, wherein said electrophotographic photosensitive member has positive charging characteristic, and wherein the main component of said material of said packaging member is selected from a group consisting of polyethylene and polypropylene.

35. A packaging member for packaging an electrophotographic photosensitive member according to claim 25, wherein said packaging member further includes a light-shielding element.

36. A packaging member for packaging an electrophotographic photosensitive member according to claim 25, wherein said packaging member includes at least two laminated layers.

37. A packaging member for packaging an electrophotographic photosensitive member according to claim 25, wherein said member is secured to each side of a base made of polyethylene, thereby providing a laminated structure.

38. A packaging member for packaging an electrophotographic photosensitive member according to claim 25, wherein said packaging member is formed as a cylindrical protecting member having a diameter substantially the same as the diameter said electrophotographic photosensitive material.

39. A packaging member for packaging an electrophotographic photosensitive member according to claim 25, wherein said cylindrical protecting member is formed from a laminated structure which is obtained by providing said packaging member on each side of a base made from polyethylene.

40. A packaging member for packaging an electrophotographic photosensitive member according to claim 39, wherein said base made from polyethylene contains 10 to 30 wt % of carbon powder dispersed therein as a pigment.

* * * * *

UNITED STATES PATENT AND TRADEMARK OFFICE

CERTIFICATE OF CORRECTION

PATENT NO. : 4,860,898

DATED : August 29, 1989

INVENTOR(S) : MASAAKI HIRO, ET AL.

It is certified that error appears in the above-identified patent and that said Letters Patent is hereby corrected as shown below:

COLUMN 1

Line 14, "electrphotographic" should read --electrophotographic--.
Line 36, "device" should read --devices--.
Line 40, "ber;" should read --ber,--.
Line 42, "an other" should read --another--.
Line 66, "defect" should read --defects--.

COLUMN 2

Line 13, "o" should read --of--.
Line 52, "be coming" should read --becoming--.

COLUMN 3

Line 30, "mmember" should read --member--.

COLUMN 4

Line 27, "making" should read --makes--.
Line 49, "photosensitvie" should read --photosensitive--.
Line 60, "polymethylmethacrylte," should read --polymethylmethacrylate,--.
Line 61, "pilyvinylchloride" should read --polyvinylchloride--.

UNITED STATES PATENT AND TRADEMARK OFFICE

CERTIFICATE OF CORRECTION

PATENT NO. : 4,860,898

DATED : August 29, 1989

INVENTOR(S) : MASAAKI HIRO, ET AL.

It is certified that error appears in the above-identified patent and that said Letters Patent is hereby corrected as shown below:

COLUMN 6

Line 6, "quarternary" should read --quaternary--.

COLUMN 7

Line 21, "arouind" should read --around--.
TABLE 2, "polysthrene plate" should read --polystyrene plate--.
Line 55, "was applied" (first occurrence) should be deleted.
Line 56, "an under" should be deleted.

COLUMN 8

Line 14, "photosnesitive" should read --photosensitive--.
Line 38, "hotosensitive member samples 5 and 6" should read --photosensitive member samples 5 and 6--.

COLUMN 9

Line 3, "arouns" should read --around--.
Line 22, "evaluatiuon" should read --evaluation--.

COLUMN 11

TABLE 6, "polyehylene sheet" should read --polyethylene sheet--.

UNITED STATES PATENT AND TRADEMARK OFFICE

CERTIFICATE OF CORRECTION

PATENT NO. : 4,860,898

DATED : August 29, 1989

INVENTOR(S) : MASAAKI HIRO, ET AL.

It is certified that error appears in the above-identified patent and that said Letters Patent is hereby corrected as shown below:

COLUMN 12

Line 27, "present invention" should read --of the present invention--.
Line 41, "dipersion" should read --dispersion--.

COLUMN 14

Line 13, "preenting" should read --preventing--.

COLUMN 15

Line 46, "electriphotographic" should read --electrophotographic--.

COLUMN 16

Line 46, "photosnesitive" should read --photosensitive--.
Line 64, "and polypropylene" should read --polypropylene--.

UNITED STATES PATENT AND TRADEMARK OFFICE

CERTIFICATE OF CORRECTION

PATENT NO. : 4,860,898

DATED : August 29, 1989

INVENTOR(S) : MASAAKI HIRO, ET AL.

It is certified that error appears in the above-identified patent and that said Letters Patent is hereby corrected as shown below:

COLUMN 18

Line 22, "diameter said" should read --diameter of said--.

Signed and Sealed this

Fifth Day of November, 1991

*Attest:*

*Attesting Officer*

HARRY F. MANBECK, JR.

*Commissioner of Patents and Trademarks*